US006904764B2

(12) United States Patent
Bassi

(10) Patent No.: US 6,904,764 B2
(45) Date of Patent: Jun. 14, 2005

(54) SERVICE DEVICE FOR A REFRIGERATOR, AND REFRIGERATOR FEATURING SUCH A DEVICE

(75) Inventor: Alberto Bassi, Turin (IT)

(73) Assignee: ITW Industrial Components S.r.l., Milan (IT)

( * ) Notice: Subject to any disclaimer, the term of this patent is extended or adjusted under 35 U.S.C. 154(b) by 0 days.

(21) Appl. No.: 10/725,582

(22) Filed: Dec. 3, 2003

(65) Prior Publication Data

US 2004/0107719 A1 Jun. 10, 2004

Related U.S. Application Data

(62) Division of application No. 10/320,725, filed on Dec. 17, 2002.

(30) Foreign Application Priority Data

Dec. 18, 2001 (IT) ..... TO2001A1191

(51) Int. Cl.[7] ..... F25D 23/00

(52) U.S. Cl. ..... 62/264; 362/92; 362/126

(58) Field of Search ..... 62/190, 229, 264, 62/297, 331, 332; 362/92, 126, 373, 294

(56) References Cited

U.S. PATENT DOCUMENTS

| | | | | | |
|---|---|---|---|---|---|
| 4,308,724 | A | * | 1/1982 | La Ginestra | 62/126 |
| 4,726,160 | A | | 2/1988 | Kawaguchi et al. | |
| 4,821,528 | A | * | 4/1989 | Tershak | 62/228.1 |
| 4,834,169 | A | | 5/1989 | Tershak et al. | |
| 4,926,654 | A | * | 5/1990 | Johnson | 62/229 |
| 4,951,481 | A | * | 8/1990 | Negishi | 62/406 |
| 5,060,486 | A | * | 10/1991 | Linstromberg | 62/229 |
| 5,184,473 | A | * | 2/1993 | Day | 62/199 |
| 5,228,308 | A | * | 7/1993 | Day et al. | 62/198 |
| 5,237,832 | A | * | 8/1993 | Alston | 62/200 |
| 5,285,652 | A | * | 2/1994 | Day | 62/199 |
| 5,374,118 | A | | 12/1994 | Kruck et al. | |
| 5,427,767 | A | | 6/1995 | Kresse et al. | |
| 5,471,849 | A | | 12/1995 | Bessler | |
| 5,660,774 | A | | 8/1997 | Stangle et al. | |
| 5,788,738 | A | | 8/1998 | Pirzada et al. | |
| 5,836,669 | A | | 11/1998 | Hed | |
| 5,851,507 | A | | 12/1998 | Pirzada et al. | |
| 5,980,058 | A | | 11/1999 | Guess et al. | |
| 5,984,997 | A | | 11/1999 | Bickmore et al. | |
| 6,059,420 | A | | 5/2000 | Rogers | |
| 6,113,807 | A | | 9/2000 | Yamaura et al. | |
| 6,150,622 | A | | 11/2000 | Malnati | |
| 6,199,400 | B1 | * | 3/2001 | Banicevic et al. | 62/408 |
| 6,228,904 | B1 | | 5/2001 | Yadav et al. | |
| 6,344,271 | B1 | | 2/2002 | Yadav et al. | |
| 6,375,834 | B1 | | 4/2002 | Guess et al. | |
| 6,379,583 | B1 | | 4/2002 | Gray et al. | |
| 6,387,981 | B1 | | 5/2002 | Zhang et al. | |
| 6,514,617 | B1 | | 2/2003 | Hubbard et al. | |
| 6,517,802 | B1 | | 2/2003 | Xiao et al. | |
| 6,569,397 | B1 | | 5/2003 | Yadav et al. | |

(Continued)

FOREIGN PATENT DOCUMENTS

| | | | |
|---|---|---|---|
| DE | 004404247 | A1 | 8/1995 |
| EP | 686818 | A | 12/1995 |
| JP | 402126077 | A | 5/1990 |
| JP | 409280722 | A * | 10/1997 |
| JP | 410009745 | A * | 1/1998 |

*Primary Examiner*—William E. Tapolcai
*Assistant Examiner*—Mohammad M. Ali
(74) *Attorney, Agent, or Firm*—Lowe Hauptman & Berner, LLP

(57) ABSTRACT

A service device for a refrigerator having a refrigerating chamber, the device having an electric circuit portion and a mechanical portion. The electric circuit portion is connectable to the refrigerator outside the refrigerating chamber, and the mechanical portion is at least partly insertable inside the refrigerating chamber and cooperates with the electric circuit portion.

15 Claims, 2 Drawing Sheets

U.S. PATENT DOCUMENTS 6,652,967 B2 11/2003 Yadav et al.
6,656,588 B1 12/2003 Laine et al.
6,667,019 B2 12/2003 Fulton et al.
2002/0178865 A1 12/2002 Yadav et al.
2003/0124050 A1 7/2003 Yadav et al.
2003/0132420 A1 7/2003 Yadav et al.

* cited by examiner

SERVICE DEVICE FOR A REFRIGERATOR, AND REFRIGERATOR FEATURING SUCH A DEVICE

This is a divisional of U.S. application Ser. No. 10/320, 725, filed Dec. 17, 2002, which is incorporated herein by reference in its entirety.

The present invention relates to a service device for a refrigerator, and to a refrigerator featuring such a device.

BACKGROUND OF THE INVENTION

As is known, refrigerators feature various electric and electronic devices, some with control and others with user-aid functions.

For example, the temperature inside the refrigerating chamber is regulated by a thermostat controlling a cooling circuit, and which normally comprises a manual selector for setting a desired temperature, a sensor for detecting the temperature inside the refrigeration chamber, and a control circuit for alternately turning the cooling circuit on and off to keep the sensor-detected temperature at around the desired set temperature The sensor and control circuit are normally housed inside a casing fixed inside the refrigerating chamber, while the manual selector projects partly from the casing to enable it to be regulated.

Refrigerators normally also comprise an internal lighting system, which is turned on when the refrigerating chamber is opened to assist the user when replacing or removing food or other material; and a lamp, e.g. a neon tube, is fitted to the ceiling or a wall of the refrigerating chamber, and is preferably guarded by a transparent shield to prevent contact with the material stored in the refrigerator.

Known refrigerators have several drawbacks, owing to the thermostat and the light source being fitted inside the refrigerating chamber. Firstly, the thermostat and light source operate in an unfavourable environment particularly exposed to humidity which, given the low temperature involved, condenses readily on the walls of the refrigerating chamber. The electronic control circuits of the thermostat, in particular, are easily damaged if not adequately protected.

Secondly, to perform even the simplest maintenance jobs, such as changing the lamp, the refrigerating chamber must be kept open for at least a few minutes, so that the temperature inside rises to substantially room temperature and takes a fairly long time to return to the set temperature once the job is completed. During which time, the material stored in the refrigerating chamber may deteriorate partly or entirely, and power consumption by the refrigerator is greatly increased.

Thirdly, the thermostat and internal lighting system occupy space which reduces the overall capacity of the refrigerating chamber.

SUMMARY OF THE INVENTION

It is an object of the present invention to provide a service device for a refrigerator, and a refrigerator, designed to eliminate the aforementioned drawbacks, and which at the same time are cheap and easy to produce.

According to the present invention, there is provided a service device for a refrigerator having a refrigerating chamber, said device comprising an electric circuit portion and a mechanical portion; characterized in that said electric circuit portion is connectable to the refrigerator outside said refrigerating chamber, and said mechanical portion is at least partly insertable inside said refrigerating chamber and cooperates with said electric circuit portion.

According to the present invention, there is also provided a refrigerator comprising a refrigerating chamber housed inside a body; a cooling circuit for cooling said refrigerating chamber; a thermostat connected to said cooling circuit to regulate a temperature inside said refrigerating chamber, and having an electronic control circuit; and lighting means having a light source for lighting the inside of said refrigerating chamber; characterized in that at least one of said electronic control circuit and said light source is housed outside said refrigerating chamber.

The thermostat and the light source thus operate in a more favourable environment and, above all, are less exposed to humidity than in conventional refrigerators.

Moreover, the thermostat and the light source are accessible from outside the refrigerating chamber, which can therefore be kept closed, and the temperature inside the refrigerating chamber kept substantially constant, when performing maintenance work.

The capacity of the refrigerating chamber is also advantageously increased.

BRIEF DESCRIPTION OF THE DRAWINGS

A non-limiting embodiment of the invention will be described by way of example with reference to the accompanying drawings, in which.

DETAILED DESCRIPTION OF THE INVENTION

Figure 1:
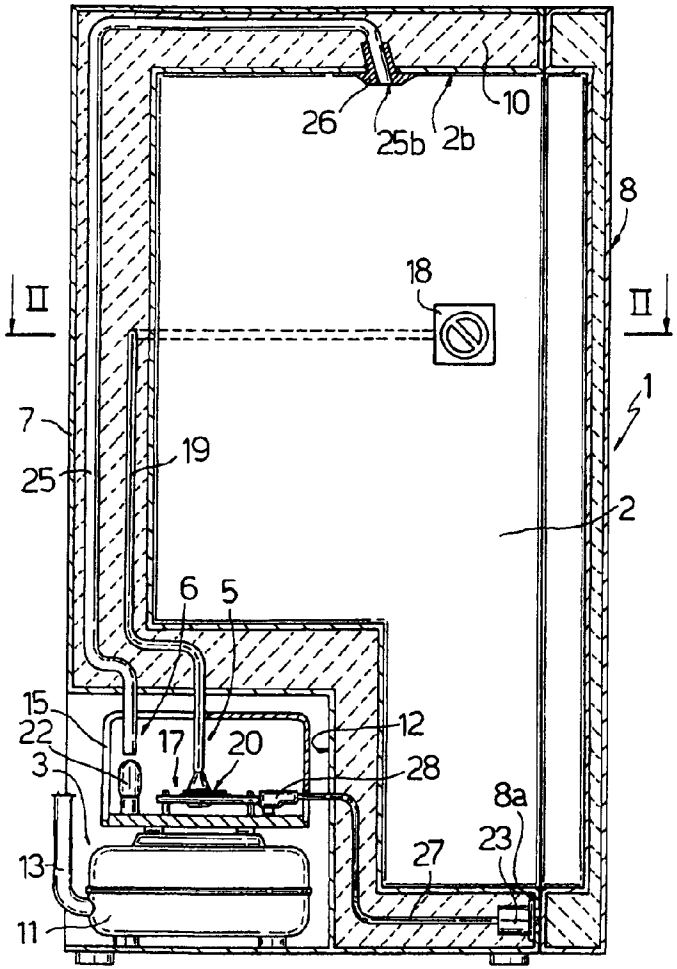
FIG. 1 shows a longitudinal lateral section of a refrigerator incorporating a service device in accordance with the present invention, and shown in a first operating configuration.
Figure 2:
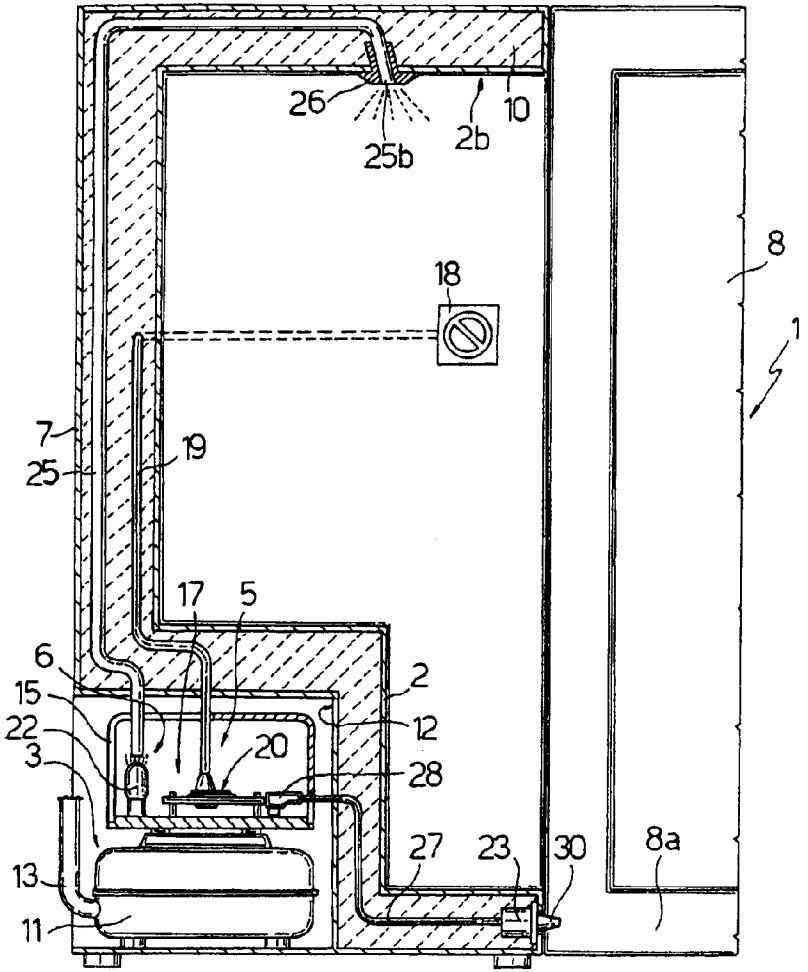
FIG. 2 shows a longitudinal lateral section of the FIG. 1 refrigerator in a second operating configuration.
Figure 3:
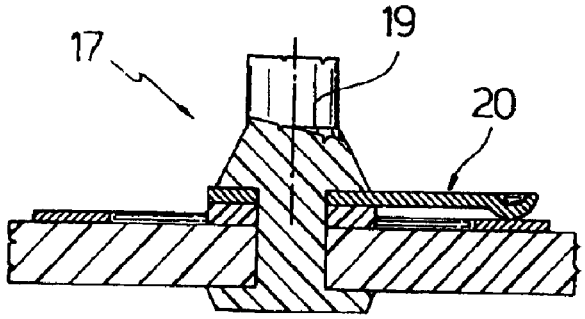
FIG. 3 shows an enlarged view of a detail of the FIG. 1 refrigerator.

FIGS. 1 and 2 show, schematically, a refrigerator in accordance with the present invention and indicated as a whole by 1. Refrigerator 1 comprises a refrigerating chamber 2; a cooling circuit 3 (shown only partly for the sake of simplicity) for cooling refrigerating chamber 2; and at least one service device in accordance with the invention. In the embodiment described, refrigerator 1 comprises a thermostat 5 and an internal lighting system 6.

Refrigerating chamber 2 is housed inside a body 7 and closed at the front by a door 8 shown closed in FIG. 1 and open in FIG. 2; and a gap 10, filled with thermally insulating material, e.g. polymer foam, is defined between refrigerating chamber 2 and body 7.

Cooling circuit 3—shown only partly for the sake of simplicity—for cooling refrigerating chamber 2 comprises at least a compressor 11 housed in a rear recess 12 of body 7, and a conduit 13 connected to compressor 11.

A control box 15, housing electric circuit components of thermostat 5 and of lighting system 6, as explained in detail later on, is fitted to compressor 11 inside rear recess 12.

Thermostat 5 is connected to cooling circuit 3 to regulate in known manner the temperature inside refrigerating chamber 2, and comprises an electronic control circuit 17; and a mechanical portion in turn comprising a manual regulating device 18 and a flexible control cable 19, and cooperating with electronic control circuit 17. Thermostat 5 also comprises a known temperature sensor (not shown) housed inside refrigerating chamber 2 and connected to electronic control circuit 17.

Electronic control circuit 17 is housed inside control box 15, and comprises a known electromechanical selector 20 for selecting a reference value of an electric quantity and so setting a desired temperature inside refrigerating chamber 2. For example, electromechanical selector 20 comprises an angular potentiometer as shown in FIG. 2.

Figure 4:
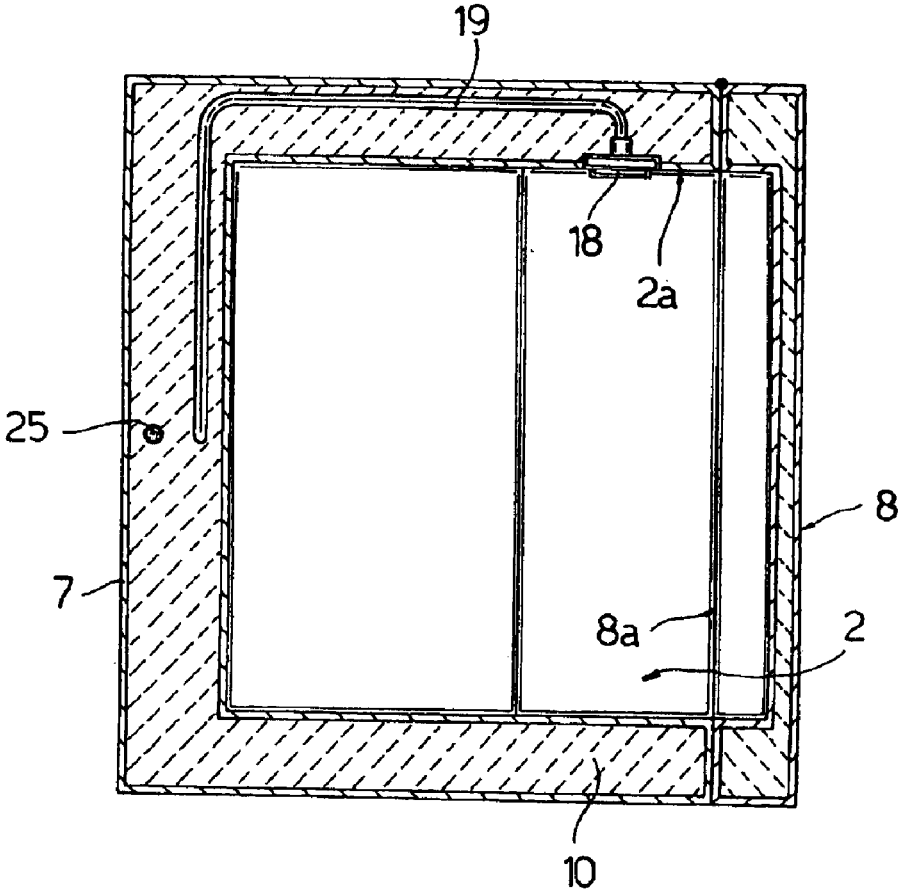
FIG. 4 shows a top plan cross section of the FIG. 1 refrigerator.

Manual regulating device 18 is located inside refrigerating chamber 2, preferably on a lateral wall 2*a* of refrigerating chamber 2, and is connected to electromechanical selector 20 by flexible control cable 19, which extends mainly inside gap 10, as shown in FIGS. 1, 2 and 4. In a preferred embodiment of the invention, flexible control cable 19 is a Bowden cable, so that electromechanical selector 20 can be remote-operated using manual regulating device 18.

Internal lighting system 6 comprises an electric light source 22, e.g. an incandescent lamp or neon tube, housed inside control box 15; a switch 23; and a mechanical portion comprising a light guide 25. More specifically, light guide 25—preferably an optical-fiber cable—extends mainly inside gap 10, and has a first end. 25*a* connected to light source 22, and a second end 25*b* facing inwards of refrigerating chamber 2 and inserted through a boss 26 substantially flush with the ceiling 2*b* of refrigerating chamber 2. That is, light guide 25 conveys at least partly inside refrigerating chamber 2 a light beam emitted by light source 22 when activated.

Switch 23 is fitted to the front of body 7, outside refrigerating chamber 2, is connected to light source 22 by a cable 27, a connector 28, and connecting tracks not shown, and is a normally-closed type with a control button 30. More specifically, switch 23 has an open first configuration in which control button 30 is released, and a closed second configuration in which control button 30 is withdrawn. Door 8 has a pressure portion 8*a* which cooperates with switch 23 to alternately turn light source 22 on and off. That is, when door 8 is closed (FIG. 1), pressure portion 8*a* presses control button 30 to open switch 23 and turn off light source 22. Conversely, when door 8 is opened (FIG. 2), control button 30 is released to close switch 23 and so turn light source 22 on.

Clearly, changes may be made to the device as described herein without, however, departing from the scope of the present invention.

What is claimed is:

1. A refrigerator, comprising a refrigerating chamber and a service device, said device comprising a thermostat including:

an electric temperature control circuit mounted in the refrigerator but outside the refrigerating chamber, said electric temperature control circuit including a setting element which is physically moveable relative to a remainder of said electric temperature control circuit, different relative positions between said setting element and the remainder of said electric temperature control circuit indicating different temperature settings for said thermostat;

a manual regulator for mechanically adjusting the relative position of said setting element and the remainder of said electric temperature control circuit, said manual regulator being mounted in the refrigerating chamber at a location accessible to a user of the refrigerator and to be physically moveable relative to a wall of the refrigerating chamber; and a flexible control cable mechanically connecting said manual regulator and said setting element of said electric temperature control circuit for mechanically transferring physical movements of said manual regulator into corresponding physical movements of said setting element, and hence, into corresponding temperature setting of said thermostat.

2. The refrigerator of claim 1, wherein said flexible control cable is a Bowden cable.

3. The refrigerator of claim 2, further comprising a light source mounted in the refrigerator but outside the refrigerating chamber; and a light guide having an end coupled to receive light from said light source and another, opposite end extending through and being fixed to a wall of the refrigerating chamber, thereby delivering the light from said light source to an interior of the refrigerating chamber.

4. The refrigerator of claim 3, further comprising a switch connected to said light source and located to be activated by a door of the refrigerator to turn said light source on and off.

5. The refrigerator as claimed in claim 1, wherein said flexible cable has a section bent at an angle of about 90°.

6. The refrigerator of claim 1, wherein the control cable is electrically isolated from said setting element.

7. The refrigerator of claim 1, wherein said setting element is a potentiometer mechanically coupled to and driven by said Bowden cable so as to be adjusted by said manual regulator.

8. The refrigerator of claim 1, wherein said cable has a physically moveable portion that moves in response to a physical movement of the manual regulator and mechanically drives the setting element of said thermostat to move in a corresponding movement.

9. A refrigerator, comprising a refrigerating chamber and a service device, said device comprising a thermostat including:

an electric temperature control circuit mounted in the refrigerator but outside the refrigerating chamber;

a manual regulator for adjusting a setting of said electric temperature control circuit, said manual regulator being mounted in the refrigerator at a location accessible to a user of the refrigerator;

a flexible control cable connecting said manual regulator and said electric temperature control circuit;

a light source mounted in the refrigerator but outside the refrigerating chamber;

a light guide having an end coupled to receive light from said light source and another, opposite end extending through and being fixed to a wall of the refrigerating chamber, thereby delivering the light from said light source to an interior of the refrigerating chamber; and a control box containing both said electric temperature control circuit of said thermostat and said light source, said control box being mounted in the refrigerator but outside the refrigerating chamber.

10. The refrigerator of claim 9, wherein said flexible control cable is a Bowden cable.

11. The refrigerator of claim 9, wherein the flexible control cable and the light guide extend through a wall of said control box, and the manual regulator and the opposite end of said light guide are located outside said control box.

12. A service device for a refrigerator having a refrigerating chamber, said device comprising:

an electric control circuit for controlling a parameter of an environment inside the refrigerating chamber, said control circuit being adapted to be mounted in the refrigerator but outside the refrigerating chamber;

a manual regulator for adjusting a setting of said electric control circuit, said manual regulator being adapted to be mounted in the refrigerator at a location accessible to a user of the refrigerator;

a flexible control cable connecting said manual regulator and said electric control circuit and converting an internal state of said manual regulator into a corresponding setting of said electric control circuit;

a light source adapted to be mounted in the refrigerator but outside the refrigerating chamber;

a light guide coupled to receive light from said light source and delivering the light from said light source to an interior of the refrigerating chamber; and a control box housing both said electric control circuit and said light source, said control box being adapted to be mounted in the refrigerator but outside the refrigerating chamber.

13. The device of claim 12, wherein said flexible control cable is a Bowden cable.

14. The device of claim 12, wherein said control circuit comprises a potentiometer coupled to and driven by said Bowden cable so as to be adjusted by said manual regulator.

15. The device of claim 12, wherein said flexible cable has at least a section angled at about 90°.

* * * * *